US006253512B1

(12) United States Patent
Thompson et al.

(10) Patent No.: US 6,253,512 B1
(45) Date of Patent: Jul. 3, 2001

(54) METHOD OF APPLYING TILES TO A ROOF

(75) Inventors: Thomas K. Thompson, Granville; Frank A. Wilgus, Jr.; Frank R. Wilgus, Sr., both of Powell; Norman L. Gansmiller, Toledo; Robert T. Fell, Jr., Holland, all of OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/292,488

(22) Filed: Apr. 15, 1999

(51) Int. Cl.[7] ..... E04F 13/00; E04F 15/00; E04F 19/00

(52) U.S. Cl. ..... 52/311.1; 52/311.2; 52/311.3; 52/313; 52/554; 52/555

(58) Field of Search ..... 52/311.1, 311.2, 52/311.3, 313, 554, 555

(56) References Cited

U.S. PATENT DOCUMENTS

| | | | | |
|---|---|---|---|---|
| 1,133,604 | | 3/1915 | Alcan . | |
| 1,583,563 | * | 5/1926 | Abraham | 52/554 |
| 1,666,429 | * | 4/1928 | Stolp | 52/554 |
| 1,685,559 | * | 9/1928 | Tobias | 52/554 |
| 1,893,944 | | 1/1933 | Johnson . | |
| 2,097,546 | | 11/1937 | Brown . | |
| 4,814,218 | | 3/1989 | Shane . | |
| 5,615,523 | | 4/1997 | Wells et al. . | |
| 5,711,126 | | 1/1998 | Wells . | |

OTHER PUBLICATIONS

"Floors and Floor Maintenance" by Walter L. Sulter, John Wiley & Sons, NY 1974, p24–25.

"Variegated Color Roofs of Weatherbest Stained–Shingles" by Weatherbest Corp., North Tonawanda, NY 1926, p3, 5, 11.

* cited by examiner

*Primary Examiner*—Carl D. Friedman
*Assistant Examiner*—Kevin McDermott
(74) *Attorney, Agent, or Firm*—Inger H. Eckert; James J. Dottavio

(57) ABSTRACT

A method of applying tiles to a roof, the tiles being of at least two different appearances, includes establishing a collection of pattern units, each pattern unit representing an arrangement of a plurality of tiles formed into a specific pattern, the specific pattern of each pattern unit being different from the specific pattern of every other pattern unit in the collection of pattern units. Each pattern unit includes representations of tiles of at least two different appearances, such as different colors. Tiles are applied according to a first one of the pattern units, to a first portion of the roof. Tiles are applied according to one of the pattern units, to a second portion of the roof that abuts the first portion of the roof. Additional tiles are applied to additional portions of the roof, the tiles being applied to each additional portion of the roof according to one of the pattern units, with each additional portion of the roof abutting a previously applied portion of the roof.

20 Claims, 6 Drawing Sheets

METHOD OF APPLYING TILES TO A ROOF

TECHNICAL FIELD AND INDUSTRIAL APPLICABILITY OF THE INVENTION

This invention relates to a method of applying tiles or shingles, or the like, to a roof deck or roof framework of residential and commercial buildings in order to achieve an aesthetically pleasing overall appearance.

BACKGROUND OF THE INVENTION

Natural slate tiles have long been used as a roof covering. Natural slate is a durable material and is considered to provide an aesthetically pleasing look or appearance to a roof. Natural slate tiles have an advantage as a roof covering in that they will not burn, and therefore they can be used in dry climates where the possibility of fires precludes wood shake roofs. Natural slate tiles are applied to a roof deck or roof framework one tile at a time in a labor intensive process, but the overall appearance of the roof of the individually laid tiles is deemed by the marketplace to be worth a premium price. One of the features of roofs of natural slate is that different sources of slate have different colors. Commonly available colors are gray or green, and different colors such as red are more scarce. Therefore, slate roofs typically have a predominant color, such as gray, with one or more additional accent colors interspersed to add variety. A typical mix of colors for a slate roof might include roughly 60 percent of the tiles having a light gray background color, about 15 percent of the tiles having a purple color, and about 25 percent of the tiles having a dark gray color.

As an alternative to the high installed cost of natural slate, roofing suppliers have developed plastic or polymer tiles, such as highly filled thermoset resin tiles. An example of such a polymer tile in the form of wood shake shingles is disclosed in U.S. Pat. Nos. 5,615,523 and 5,711,126, both to Wells et al.

One problem with applying tile roofs, such as natural slate roofs or polymer slate roofs, is that where two or more colors are used on the roof, care must be taken to assure that the tiles are not inadvertently laid down in such a manner that there are undesirable patterns or grouping of colors. A typical undesirable pattern is stair stepping or racking. It is considered unattractive to have repeat patterns of the accent colors, such as red or purple, that are interspersed with the background color, such as green. Also, areas of high concentration of the tiles of the accent colors are not desirable. Even when attempts are made to apply the tiles in an entirely random manner, patterning, either in the overall roof, or in localized areas, can be evident in the finished roof. Patterning is the existence of repeat patterns of various colors, or areas of high concentration of tiles of the accent colors, that are readily observable to the casual observer. In some cases concern for avoiding patterning, that might inadvertently result from having the installer apply the tiles in a traditional manner, have lead to the practice of having an architect or the installer draw up a plan for an entire roof, tile by tile. This greatly increases the installed cost of the roof, and reduces the number of installers qualified to apply such roofs.

Past attempts to provide an attractive, aesthetically pleasing roof appearance for tile roofs include the patterning method for laying shingles or tiles disclosed in U.S. Pat. No. 1,893,944 to Johnson. The system in the Johnson patent requires the use of hexagonal-shaped tiles that have a first color on one side and a second color on the other side. The tiles are invertable so that the installer can lay all of the tiles down on the surface and then flip over selected ones of the tiles to form the desired pattern. In order to facilitate installation, the Johnson patent states at page 3, line 19 that the installer can be supplied with a picture or photograph of the desired design to follow when laying out the pattern of the tiles or shingles. All of the patterns suggested involve diagonal bands of tiles of one color interspersed with diagonal bands of tiles of the other color. The system in the Johnson patent uses a numerical table to suggest numerous differences in selecting the tiles that are to be inverted, so that an indefinite number of designs—all symmetrical—can be produced. If the pattern is repeated by the installer, the pattern established at the beginning edge or side of the roof in the Johnson method will repeat itself across the roof. Alternatively if the installer chooses to vary the pattern according to the Johnson method, the roof will contain a continuously changing pattern that extends across the whole roof. In either instance, each of the patterns created by inverting some of the hexagonal tiles will be a symmetrical pattern. These patterns will be quite apparent to the casual observer observing the roof after its completion.

Another attempt to provide an attractive, aesthetically pleasing roof appearance for tile roofs is disclosed in a brochure by Weatherbest Corp entitle "Variegated Color Roofs of Weatherbest Stained Shingles". The Weatherbest brochure discloses that the different colored shingles are mixed together in the desired percentages of color mixing at the Weatherbest factory and then rebundled, thereby enabling the installer to lay the shingles just as they come from the bundle. While this method would enable the manufacturer to predetermine the exact proportion of the various colors, the overall pattern could not be predetermined since there would be no assurance that the installer would lay out the shingles according to the actual predetermined pattern. Furthermore, most roofing installers work by establishing themselves at a first position on a roof and then installing all the tiles in the entire reachable portion of the roof before moving to a subsequent position on the roof. Therefore, there would be resistance to applying the tiles one row at a time, across the entire width of the roof. An additional problem with the method of mixing tiles of different colors in the bundles before shipping is the expense of mixing and repackaging tiles of the different colors.

It would be advantageous if there could be developed a roof tile installation method that would impart an aesthetically pleasing appearance to the roof and would eliminate patterning. Such a method would ideally enable the roof tile installer to apply the tiles in a convenient and efficient manner, and would overcome other deficiencies of the previously known methods of tile installation.

SUMMARY OF THE INVENTION

The above objects as well as other objects not specifically enumerated are achieved by a method of applying tiles to a roof, the tiles being of at least two different appearances. The method of the invention includes establishing a collection of pattern units, each pattern unit representing an arrangement of a plurality of tiles formed into a specific pattern, the specific pattern of each pattern unit being different from the specific pattern of every other pattern unit in the collection of pattern units. Each pattern unit includes representations of tiles of at least two different appearances, such as different colors. Tiles are applied according to a first one of the pattern units, to a first portion of the roof. Tiles are applied according to one of the pattern units, to a second portion of the roof that abuts the first portion of the roof. Additional tiles are applied to additional portions of the roof, the tiles being applied to each additional portion of the roof according to one of the pattern units, with each additional portion of the roof abutting a previously applied portion of the roof.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
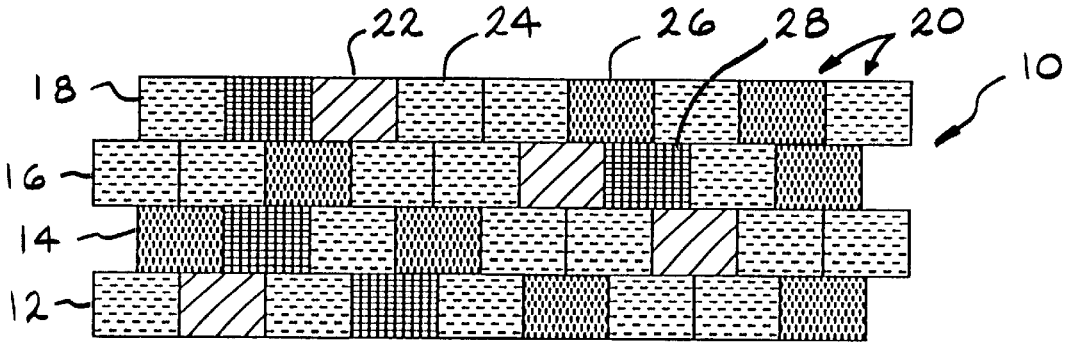
FIGS. 1–4 are schematic plan views of four related pattern units of the invention, each of the pattern units having four colors.

As shown in FIG. 1, the first pattern unit 10 represents an arrangement of four rows 12, 14, 16 and 18 of tiles, generally indicated at 20. It is to be understood that the tiles 20 have an exposed portion, as indicated in the drawings, and a headlap or covered portion, not shown, that is covered by the next upward or upslope row or course of tiles. For example, the headlap or covered portion of the tiles in row 12 are covered by the tiles in row 14 which is upslope from row 12. The tiles are of four different colors, indicated at 22, 24, 26 and 28, respectively. As an example of a color scheme that could be used for the first pattern unit 10, tiles 22 are cedar, a medium brown color; tiles 24 are aspen, a light gray color; tiles 26 are a chilibar or dark gray color; and tiles 28 are walnut, a very dark brown color. The approximate percentages of the four colors in each of the first pattern units are as follows: cedar tiles 22–11 percent; aspen tiles 24–55 percent; chilibar tiles 26–22 percent; and walnut tiles 28–11 percent. As shown in FIG. 1, alternating rows are shifted sideways, so that rows 14 and 18 are laterally offset from rows 12 and 16 by a distance equal to approximately one-half the width of the tiles, although the offset distance could be any amount. This is an aesthetically pleasing arrangement, and also prevents water infiltration to the roof deck by assuring that the joint between adjacent tiles will not directly overlie a joint in the course or row immediately downslope or upslope.

Figure 2:
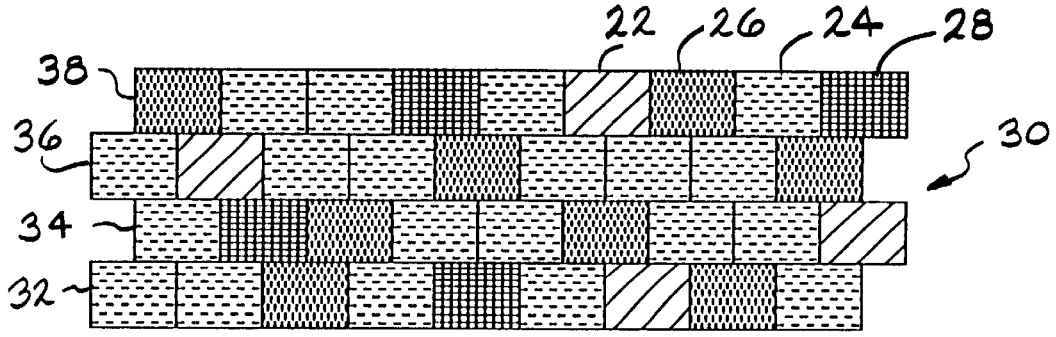
Figure 3:
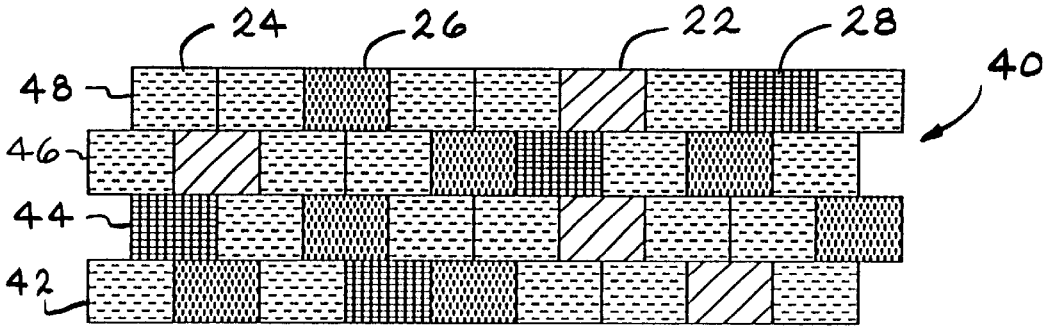
Figure 4:
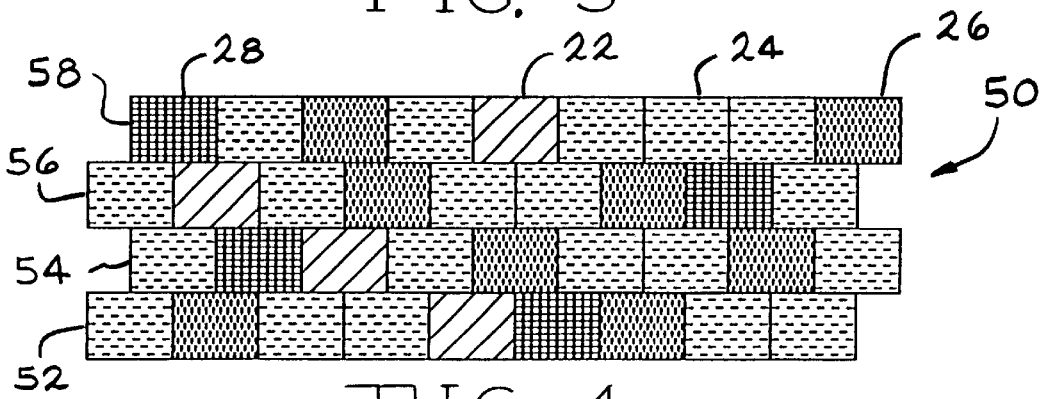

As shown in FIG. 2, the second pattern unit 30 represents an arrangement of four rows 32, 34, 36 and 38 of tiles, with the tiles including the same colors, 22, 24, 26 and 28. The percentages of each color of tile in the second pattern 30 is roughly the same as those for the colors in the first pattern 10. In the same manner, pattern unit 40 in FIG. 3 represents an arrangement of four rows 42, 44, 46 and 48 of tiles, with the tiles including the same colors, 22, 24, 26 and 28. Likewise, pattern unit 50 in FIG. 4 represents an arrangement of four rows 52, 54, 56 and 58 of tiles, with the tiles including the same colors, 22, 24, 26 and 28.

Together, the four pattern units, 10, 30, 40 and 50 shown in FIGS. 1–4 form a collection of pattern units, the pattern units being similar in that they have not only the same four colors, but also have the same percentages of each color. It can be observed that the pattern of tiles in each of the four pattern units is different from the pattern in each of the other pattern units. Another characteristic of the collection of pattern units 10, 30, 40, and 50 shown in FIGS. 1–4 is that the four pattern units 10, 30, 40, and 50 are compatible with each other. The term "compatible" in this context means that the final look or effect of the roof of tiles installed according to the patterns units is aesthetically pleasing, and repeat patterns or localized patterning are not apparent to the casual observer. It is to be understood that the percentages of each color in each of the pattern units 10, 30, 40 and 50 do not have to be the same for all of the related or compatible pattern units in the collection, although it is preferred that the percentages are the same.

Figure 5:
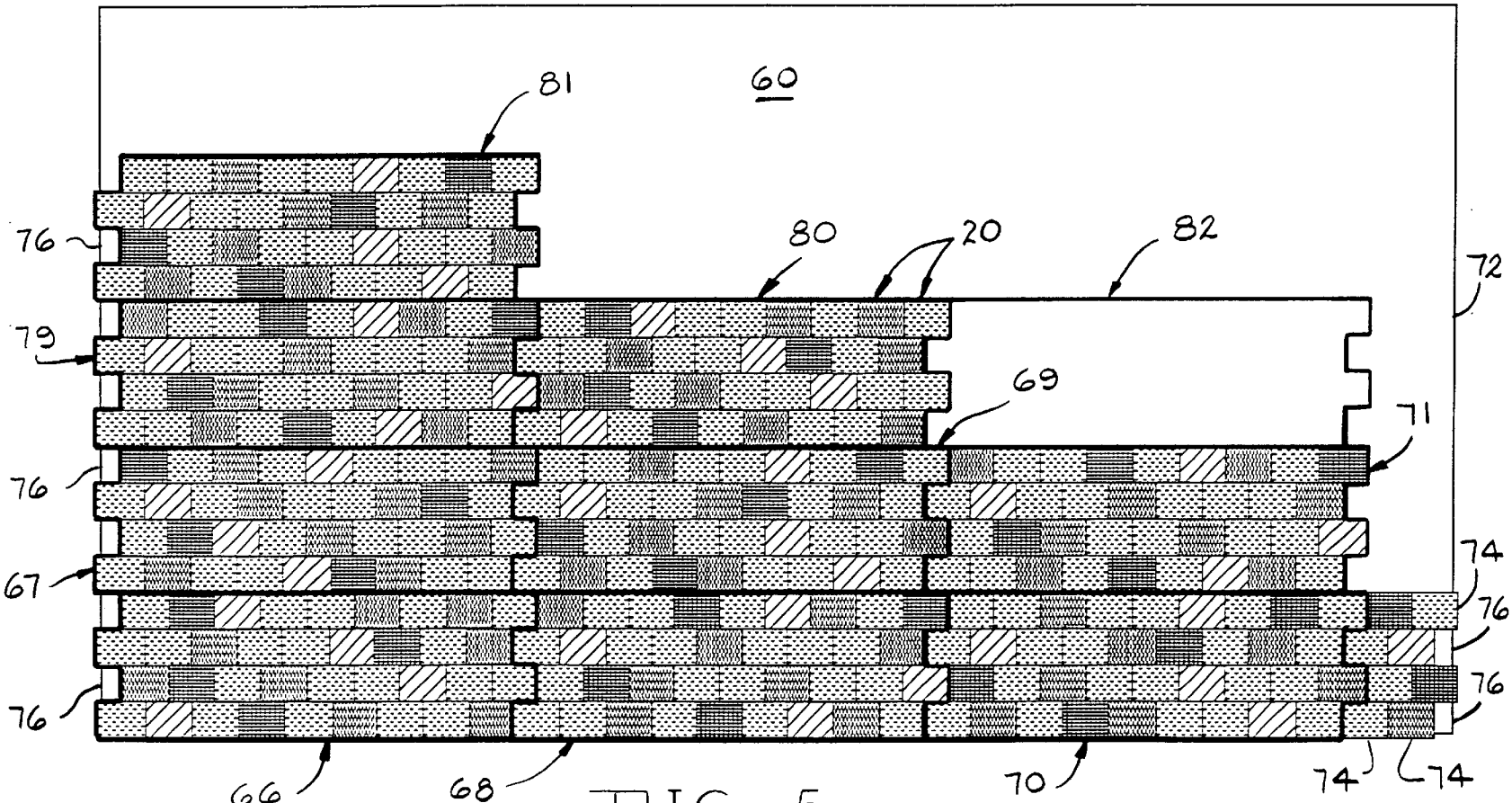
FIG. 5 is a schematic plan view of a roof that is partially covered with slate roof tiles according to the pattern units shown in FIGS. 1–4.

As shown in FIG. 5, tiles 20 have been laid on a roof deck 60, with enough tiles laid to partially cover the roof deck 60. The tiles have been laid onto the roof deck according to a number of different pattern units. For purposes of illustration the tiles in each of the individual pattern units have been outlined in FIG. 5 so that the pattern units will be readily apparent. It is to be understood, as shown in the completed roof of FIG. 6, that such outlining is not actually seen on the roof. The tiles laid according to the first pattern unit 66, have been laid onto a first portion of the roof, not shown. The first portion of the roof has the same shape and size as the collection of tiles of the first pattern unit 66, and lies directly underneath the first pattern unit. After the tiles are laid or installed onto the first roof portion according to the first pattern unit 66, tiles are laid or installed according to a second pattern unit 68 that overlies a second portion of the roof, not shown, that lies directly underneath the tiles in the second pattern unit 68. The second portion of the roof abuts the first portion of the roof. Likewise, the next subsequent batch of tiles is laid onto a roof portion, not shown, that underlies the tiles installed according to the third pattern unit 70. Therefore, it can be seen that tiles can be applied to additional portions of the roof, the tiles being applied to each additional portion of the roof according to one of the pattern units, with each additional portion of the roof abutting a previously applied portion of the roof.

As shown in FIG. 5, the tiles in the first pattern unit 66 are laid according to pattern unit 10 indicated in FIG. 1, the tiles in the second pattern unit 68 are laid according to pattern unit 30, and the tiles in the third pattern unit 70 are laid according to pattern unit 40. Although the tiles in each pattern unit are laid according to a pattern unit different from the previous pattern unit, it is to be understood that the pattern units can be repeated for abutting portions of the roof. An additional string of pattern units 67, 69 and 71 are laid upslope from the lower string of pattern units 66, 68 and 70. Pattern units 79, 80 and 81 are also shown as being applied. It is to be understood that although pattern units 66, 79 and 81 are shown as being generally vertically aligned, they can be staggered laterally by starting one or more pattern units at the left side of the roof 60 with a partial pattern unit or with some transition tiles, not shown. This may also be necessary where the left edge of the roof surface is irregular, such as where the left side is a valley.

Figure 6:
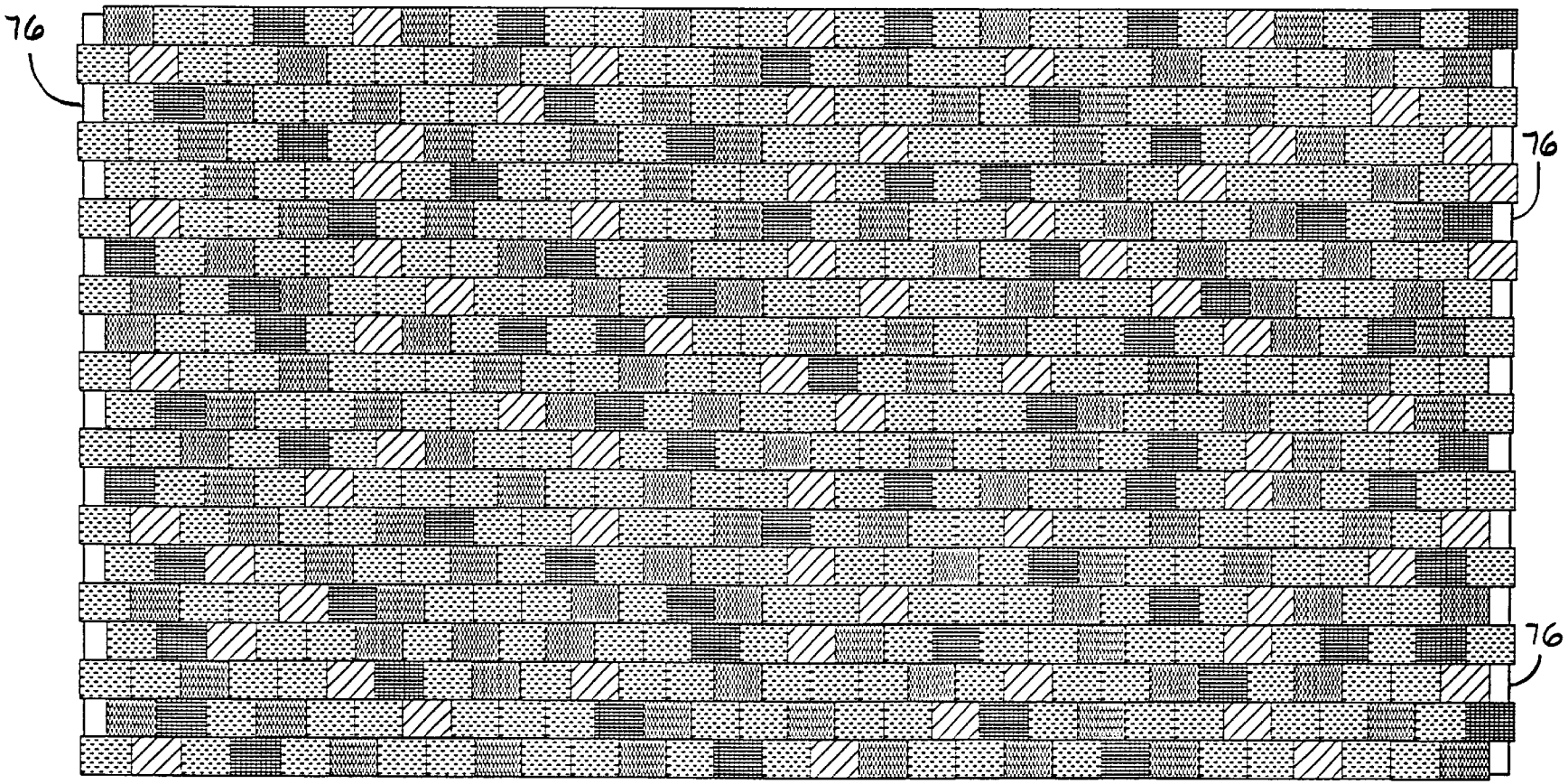
FIG. 6 is a schematic plan view of the roof of FIG. 5 that is completely covered with slate roof tiles according to the pattern units shown in FIGS. 1–4.
Figure 7:
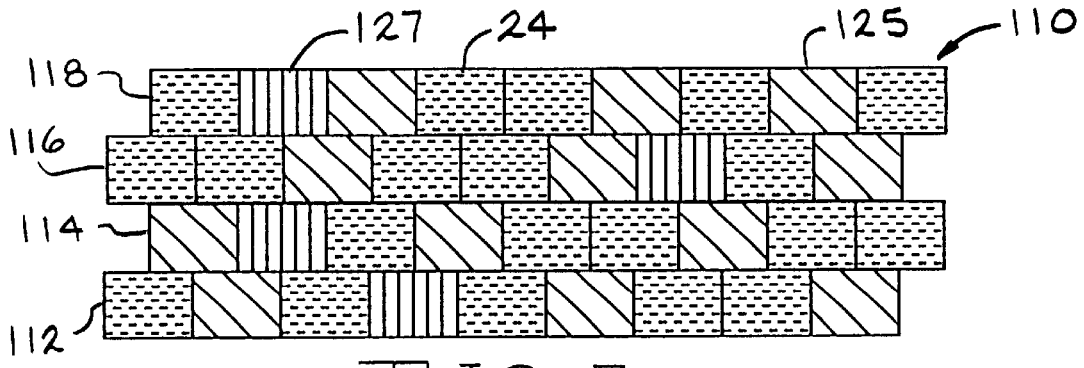
FIGS. 7–10 are schematic plan views of a different set of four related pattern units of the invention, each of the pattern units having three colors.

As shown in FIG. 5, because the right hand edge 72 of the roof 60 has been reached, a complete pattern unit of tiles cannot be applied to the roof to the immediate right of pattern unit 70. Therefore, eight tiles, indicated generally at 74, are installed to reach the edge 72 of the roof. It is to be understood that since alternate rows of tiles are staggered laterally, there will be a need to install half tiles or tiles of partial width, not shown, to uncovered roof portions 76 at the roof edges. As shown in FIG. 6 the roof deck is covered except for the uncovered roof portions 76 at the roof edges, which will be covered by tiles of partial width.

As shown in FIG. 5, a pattern unit 80 of tiles has been laid according to pattern unit 10 on a portion of the roof. The next abutting portion of the roof is indicated at 82 in outline form. The slate tile installer can select any one of the pattern units 10, 30, 40, 50 in the collection of pattern units shown in FIGS. 1–4 to use as a guide in applying the slate tiles in next abutting portion of the roof 82.

The arrangement of tiles for each of the pattern units 10, 30, 40, and 50 has been developed using a multipurpose computer. A guideline followed was that the smaller the percentage of a specific color, the greater the inclination to spread out the tiles of that color within the pattern unit to avoid patterning on the roof.

Typical natural slate tiles have dimensions of about 13 inches across (laterally) and about 22 inches long (in the upslope and downslope direction). It is to be understood that tiles of different dimensions can be used. The pattern units shown in FIGS. 1–4 include 4 rows having 9 tiles in each row. These parameters have been selected because it has been determined that a pattern unit this size is what can readily be reached by an installer from one installation position or toe board on the roof during installation. It is to be understood that pattern units having a different number of rows or tiles in each row can be used with the installation method of the invention. Also, although the pattern units are shown as being generally horizontally or laterally oriented, it is to be understood that the pattern units could be oriented in a more vertical arrangement. Preferably, each pattern unit comprises at least 3 rows of tiles from top to bottom and at least 6 tiles laterally across each row. It is preferred that the design of the pattern units fits the work environment and practical capabilities of the installers, such as the typical ladders, scaffolding and toe boards, and reach of the installers.

Although the description above pertains to the method of installing natural slate tiles on a roof, it is to be understood that the method of the invention can be used to install other materials to create aesthetically pleasing roof coverings. Examples include plastic or polymeric slate tiles, plastic or polymeric wood shake tiles, stone tiles of materials other than natural slate, tiles of cementitious materials, asphalt shingles, wooden shingles and shakes, and plastic tiles, including reinforced PVC tiles. All of these materials are considered as being "tiles" for purposes of the invention.

As previously indicated with reference to FIG. 5, additional tiles 74 are necessary to complete the lower courses of the roof, after the installation of the tiles in third pattern unit 70. This could occur either at the edge 72 of the roof, or when meeting a valley. A related feature of the invention is that after tiles of a pattern unit are partially laid, a new pattern unit, or the same pattern unit, can be started all over again. The pattern unit need not be completely installed prior to the commencement of the next pattern unit. For example, if the installer has a pattern unit partially completed, such as by laying the first four tiles of each of the four rows of pattern unit 10, and the installer loses track of how much of the pattern unit has been completed, the installer can simply start over with the same pattern unit or with a different pattern unit. Losing track of the pattern could occur, for example, when the installer stops work at the end of the day.

As shown in FIGS. 7–10, in a different set of four related pattern units of the invention, each of the pattern units has three colors. The first pattern unit 110 represents an arrangement of four rows 112, 114, 116 and 118 of tiles. The tiles are of three different colors, indicated at 24, 125, and 127, respectively. As an example of a color scheme that could be used for the first pattern unit 110, tiles 24 are aspen, a light gray color; tiles 125 are green; and tiles 127 are red. The approximate percentages of the three colors in the first pattern unit are as follows: aspen tiles 24–55 percent; green tiles 125–33 percent; and red tiles –11 percent. In a manner similar to that shown for pattern unit 10 in FIG. 1, alternating rows are shifted sideways, so that rows 114 and 118 are laterally offset from rows 112 and 116 by a distance equal to approximately one-half the width of the tiles.

Figure 8:
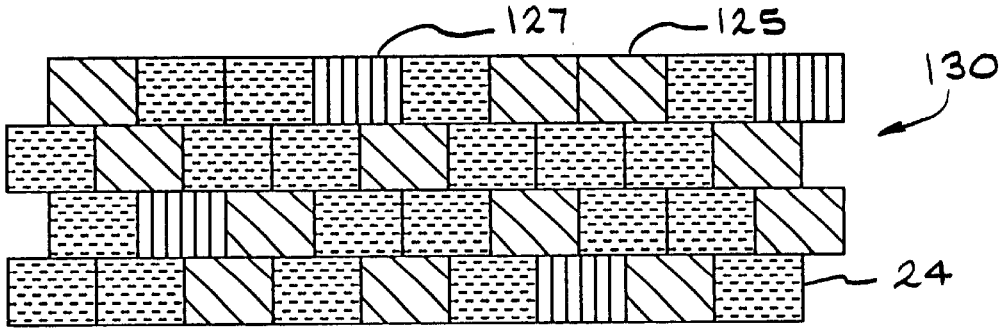
Figure 9:
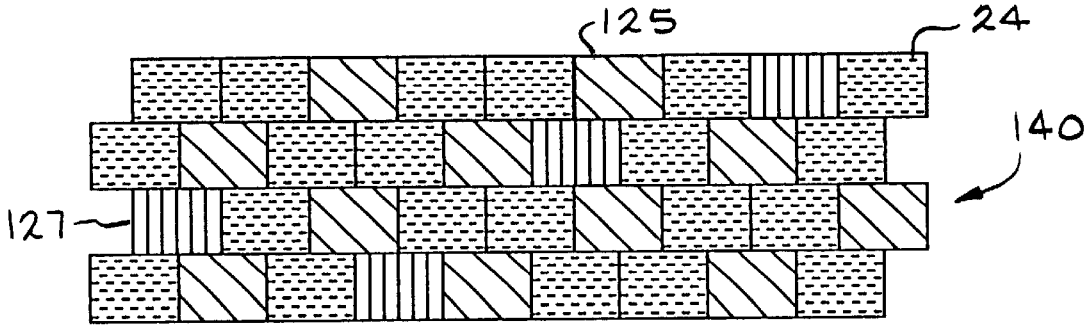
Figure 10:
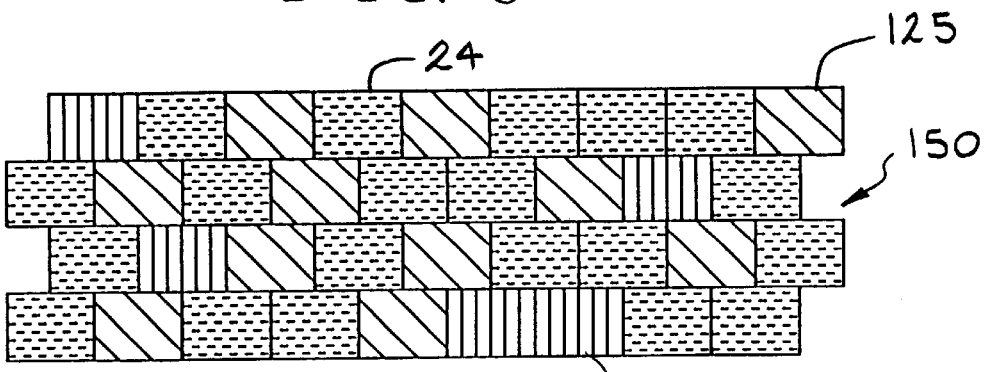

As shown in FIG. 8, the second pattern unit 130 represents an arrangement of four rows of tiles, with the tiles including the same colors, 24, 125 and 127 as in pattern unit 130. The percentages of each color of tile in the second pattern 130 is roughly the same as those for the colors in the first pattern 110. In the same manner, pattern unit 140 in FIG. 9 represents an arrangement of four rows of tiles, with the tiles including the same colors, 24, 125 and 127. Likewise, pattern unit 50 in FIG. 4 represents an arrangement of four rows of tiles, with the tiles including the same colors, 24, 125 and 127.

Together, the four pattern units, 110, 130, 140 and 150 form a collection of pattern units, the pattern units being similar in that they have not only the same three colors, but also have the same percentages of each color. The pattern of tiles in each of the four pattern units 110, 130, 140 and 150 is different from the pattern in each of the other pattern units, but the pattern units in the collection of pattern units 110, 130, 140, and 150 are compatible with each other.

Figure 11:
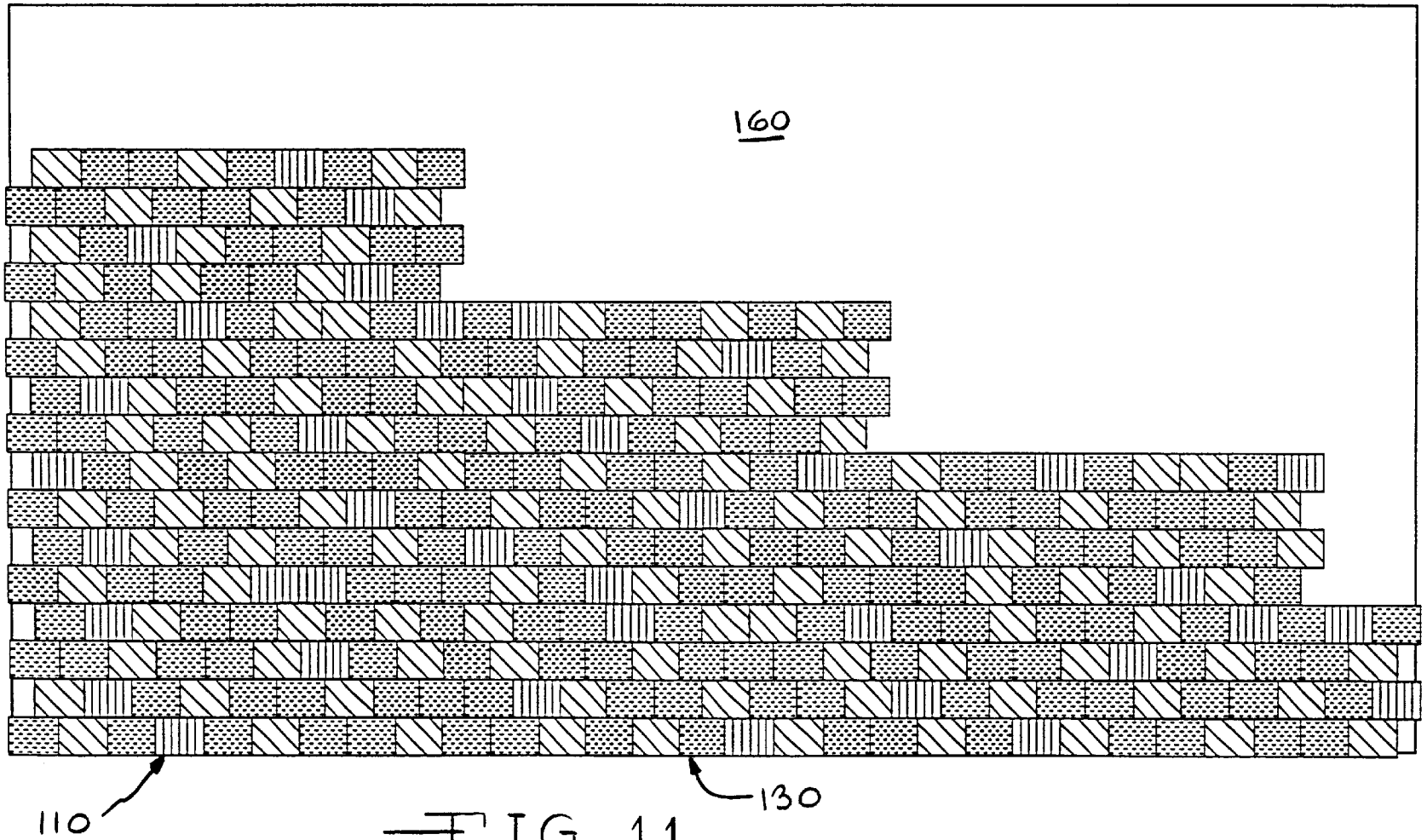
FIG. 11 is a schematic plan view of a roof that is partially covered with slate roof tiles according to the pattern units shown in FIGS. 7–10.
Figure 12:
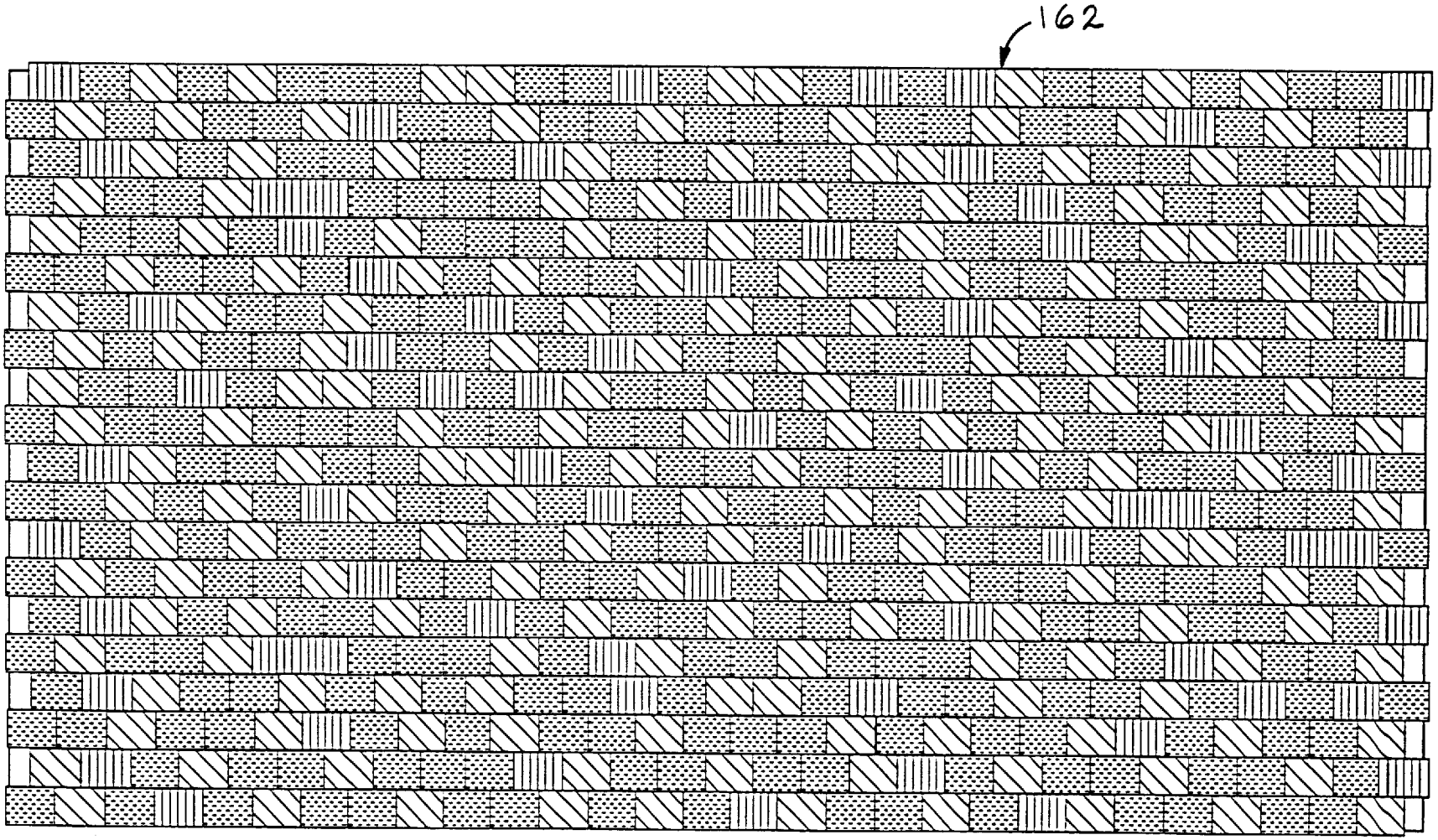
FIG. 12 is a schematic plan view of the roof of FIG. 1I1 that is completely covered with slate roof tiles according to the pattern units shown in FIGS. 7–10.

As shown in FIG. 11, tiles have been laid on a roof deck 160, with enough tiles laid to partially cover the roof deck. The tiles have been laid onto the roof deck according to a number of different pattern units. It can be seen that tiles have been laid according to the first pattern unit 110 in the lower left corner of the roof deck 160. The completed roof is indicated at 162 in FIG. 12. After the tiles are laid or installed onto a first roof area according to the first pattern unit 110, tiles are laid or installed according to a second pattern unit 130 that overlies a second portion of the roof, not shown, that lies directly underneath the tiles in the second pattern unit 130. The is second portion of the roof abuts the first portion of the roof, in the manner described above with reference to FIGS. 1–6. Tiles can be applied to additional portions of the roof, the tiles being applied to each additional portion of the roof according to one of the pattern units, with each additional portion of the roof abutting a previously applied portion of the roof.

While the examples of patterns shown in FIGS. 1–6 show four different colors, and the patterns shown in FIGS. 7–12 show three colors, the method of the present invention can be used as long as there are at least two different colors. Preferably, the number of colors is within the range of from about 2 to about 5. Also, although the differences in appearance between the different tiles have been described using different colors, it is to be understood that the different appearances distinguishing different tiles could be one or more other visually distinguishing attributes, such as the texture, thickness, reflectivity or shape of the tiles.

Any number of pattern units in the collection of pattern units can be used with the method of the present invention, although a number within the range of from about 2 to about 6 is preferred. In order to provide flexibility in designing patterns and to reduce the chances of unwanted patterning on the roof, it is preferred that the color percentages in each row and in each small section, e.g., quadrant, of the pattern units be substantially the same as the overall color mix.

In order to increase the efficiency of the installation process, it is preferred that copies of all of the pattern units in the collection of pattern units be converted to a portable form that can be used by the installer on the roof. For example, the pattern units 10, 30, 40 and 50 can be applied to four different cue cards that can be hand held during use on the roof by a tile installer. Any portable medium, such as a pocket sized electronic display device, can be used by the installer on the roof. Also, the use of the predetermined pattern units to install the roof not only assures that the roof will contain no undesirable patterning, but also enables the roofing contractor to show the homeowner what the completed roof will look like.

It is to be understood that the terms "abuts" and "abutting" includes not only the traditional concept of having the tiles in one roof portion actually touching the tiles in the previous roof portion, but also allows for the inadvertent or intentional insertion of a small number of tiles between adjacent roof portions, so that the tiles laid according to one pattern unit would be slightly separated from the tiles of the next pattern unit by a few transition tiles.

The principle and mode of operation of this invention have been described in its preferred embodiments. However, it should be noted that this invention may be practiced otherwise than as specifically illustrated and described without departing from its scope.

What is claimed is:

1. A method of applying tiles to a roof, the tiles being of at least two different appearances, the method comprising:

establishing a collection of pattern units, each pattern unit representing an arrangement of a plurality of tiles formed into a specific pattern, the specific pattern of each pattern unit being different from the specific pattern of every other pattern unit in the collection of pattern units, and each pattern unit including representations of tiles of at least two different appearances;

applying tiles, according to a first one of the pattern units, to a first portion of the roof;

applying tiles, according to one of the pattern units, to a second portion of the roof that abuts the first portion of the roof; and applying tiles to additional portions of the roof, the tiles being applied to each additional portion of the roof according to one of the pattern units, with each additional portion of the roof abutting a previously applied portion of the roof.

2. The method of claim 1 in which the at least two different appearances comprises at least two different colors.

3. The method of claim 2 in which the number of colors is within the range of from about 2 to about 5.

4. The method of claim 1 in which the number of pattern units in the collection of pattern units is within the range of from about 2 to about 6.

5. The method of claim 1 in which each pattern unit comprises at least 3 rows of tiles from top to bottom and at least 6 tiles laterally across each row.

6. The method of claim 5 in which each pattern unit comprises 4 rows of tiles from top to bottom and 9 rows of tiles across each row.

7. The method of claim 5 in which the tiles of each row are laterally offset from the tiles of each abutting row above and below each said row.

8. The method of claim 1 in which the pattern units are placed on a portable medium suitable for being hand held during use on the roof by a tile installer.

9. The method of claim 1 in which the tiles applied to a portion of the roof are applied according to the same pattern unit as the pattern unit according to which the tiles are applied to a previous abutting portion of the roof.

10. The method of claim 1 in which each pattern unit comprises rows of tiles, in which the at least two different appearances comprises at least two different colors, and in which the color percentages in each row of the pattern units are substantially the same as the overall color mix of the pattern unit.

11. The method of claim 10 in which the number of appearances is within the range of from about 2 to about 5.

12. A method of applying tiles to a roof, the tiles being of at least two different appearances, the method comprising:

establishing a collection of pattern units, where the number of pattern units in the collection of pattern units is within the range of from about 2 to about 6, each pattern unit representing an arrangement of a plurality of tiles formed into a specific pattern, the specific pattern of each pattern unit being different from the specific pattern of every other pattern unit in the collection of pattern units, and each pattern unit including representations of tiles of at least two different colors, and no more than five different colors;

applying tiles, according to a first one of the pattern units, to a first portion of the roof;

applying tiles, according to one of the pattern units, to a second portion of the roof that abuts the first portion of the roof; and applying tiles to additional portions of the roof, the tiles being applied to each additional portion of the roof according to one of the pattern units, with each additional portion of the roof abutting a previously applied portion of the roof.

13. The method of claim 12 in which each pattern unit comprises at least 3 rows of tiles from top to bottom and at least 6 tiles laterally across each row.

14. The method of claim 13 in which each pattern unit comprises 4 rows of tiles from top to bottom and 9 rows of tiles across each row.

15. The method of claim 14 in which the tiles of each row are laterally offset from the tiles of each abutting row above and below each said row.

16. The method of claim 15 in which the pattern units are placed on a portable medium suitable for being hand held during use on the roof by a tile installer.

17. The method of claim 16 in which each pattern unit comprises rows of tiles, and in which the color percentages in each row of the pattern units are substantially the same as the overall color mix of the pattern unit.

18. The method of claim 12 in which the pattern units are placed on a portable medium suitable for being hand held during use on the roof by a tile installer.

19. The method of claim 12 in which each pattern unit comprises rows of tiles, and in which the color percentages in each row of the pattern units are substantially the same as the overall color mix of the pattern unit.

20. A method of applying tiles to a roof, the tiles being of at least two different appearances, the method comprising:

establishing a collection of pattern units, each pattern unit representing an arrangement of a plurality of tiles formed into a specific pattern, the specific pattern of each pattern unit being different from the specific pattern of every other pattern unit in the collection of pattern units, and each pattern unit including representations of tiles of at least two different colors, where each pattern unit comprises rows of tiles, the color percentages in each row of the pattern units are substantially the same as the overall color mix of the pattern unit, and the number of pattern units in the collection of pattern units is within the range of from about 2 to about 6;

applying tiles, according to a first one of the pattern units, to a first portion of the roof;

applying tiles, according to one of the pattern units, to a second portion of the roof that abuts the first portion of the roof; and applying tiles to additional portions of the roof, the tiles being applied to each additional portion of the roof according to one of the pattern units, with each additional portion of the roof abutting a previously applied portion of the roof.

* * * * *